United States Patent [19]

Mo

[11] 4,087,984

[45] May 9, 1978

[54] MARINE STRUCTURE FOR DRILLING AFTER AND/OR PRODUCTION OF HYDROCARBONS

[75] Inventor: Olav Mo, Asker, Norway

[73] Assignee: A/S Hoyer-Ellefsen, Norway

[21] Appl. No.: 694,431

[22] Filed: Jun. 9, 1976

[30] Foreign Application Priority Data

Jun. 18, 1975 United Kingdom ..... 25970/75

[51] Int. Cl.[2] ..... E02B 17/00

[52] U.S. Cl. ..... 61/94; 61/86; 61/95

[58] Field of Search ..... 61/94, 87, 88, 98, 95, 61/99, 100; 114/259–263

[56] References Cited

U.S. PATENT DOCUMENTS

| | | | |
|---|---|---|---|
| 2,972,973 | 2/1961 | Thearle | 61/87 X |
| 2,986,889 | 6/1961 | Ludwig | 61/94 |
| 3,036,438 | 5/1962 | Sims | 61/87 X |
| 3,386,407 | 6/1968 | Mount | 61/98 X |
| 3,597,931 | 8/1971 | Hard | 61/98 |
| 3,686,886 | 8/1972 | Georgii | 61/94 X |

FOREIGN PATENT DOCUMENTS

| | | | |
|---|---|---|---|
| 987,506 | 4/1976 | Canada | 166/.5 |
| 1,389,216 | 1/1965 | France | 61/98 |

*Primary Examiner*—Dennis L. Taylor

*Attorney, Agent, or Firm*—Larson, Taylor and Hinds

[57] ABSTRACT

A floating offshore platform is provided which, in operation, is anchored to the sea bed by an anchoring device. The platform includes an elongate column-like structure which, in operation, floats in an upright position. An anchoring device is connected to the elongate structure by at least one vertically extending cable or the like which is tensioned to restrain vertical displacement of the structure, and a plurality of generally horizontally extending members which interconnect the lower end of the structure with the anchoring device so as to restrain lateral displacement of the lower end of the structure. With this arrangement, the column-like structure behaves as a floating column pivoted to the sea bed.

9 Claims, 12 Drawing Figures

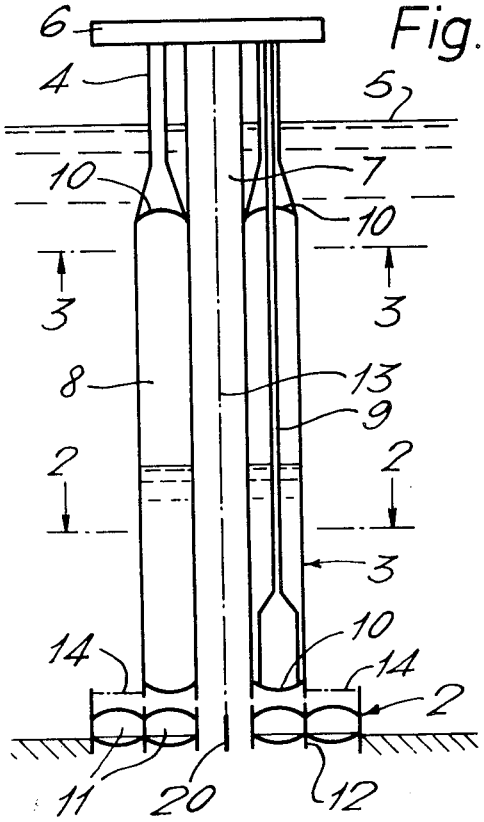
Fig.1.
Fig.2.
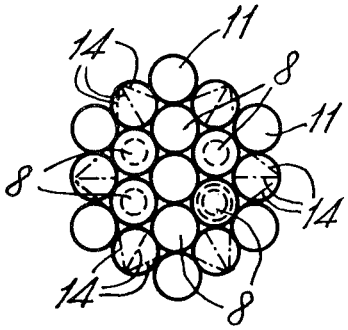
Fig.3.
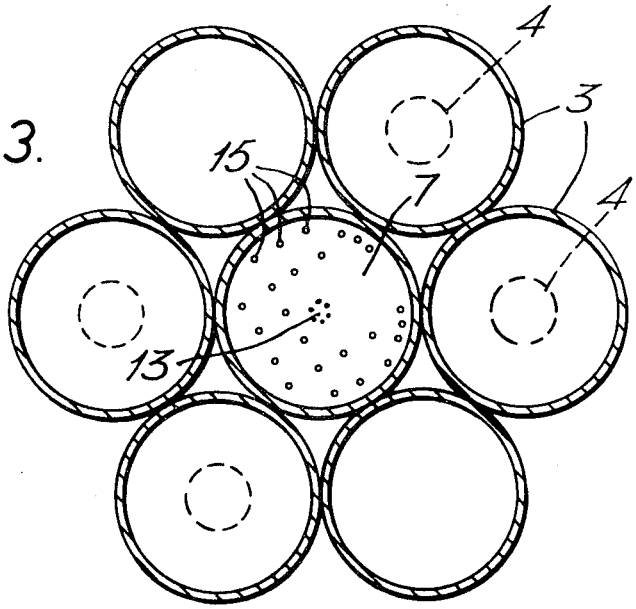

MARINE STRUCTURE FOR DRILLING AFTER AND/OR PRODUCTION OF HYDROCARBONS

The present invention is directed towards a floating structure. More particularly, the invention is concerned with a floating structure from which for example drilling operations and/or production of hydrocarbons or the like may be conducted. The invention embodies a floating structure which has an oscillating column anchored to the sea bed and is kept stable by upward hydrostatic pressure, with storage means in the column and/or the anchor means.

The invention may be briefly described as a floating structure or foundation comprising partly or fully submerged buoyancy means and anchor means for attachment to the bottom of a body of water in which the structure is floating. The floating structure is attached to the anchor means by a vertical elongated member and by a plurality of more or less horizontal members interconnecting the floating structure and the anchor means. The interconnecting means employed to connect the structure with the anchors are preferably flexible, and suitably may be cables of wire, chain, rods, tubes or the like.

Present developments in the off-shore oil and gas exploration have proved that the drilling and production of subaqueous mineral deposits will increase significantly in the near future and will be extended to sites further from shore and at greater depths. The production of fluid minerals from these sites creates many new problems, not the least of which is that of storing of a produced fluid until it can be transported away. As the sites for the production of subaqueous mineral deposits move further and further from shore to sites with larger and larger depths, the expenses involved in laying product pipelines on the sea bed from the off-shore production units to shore will increase considerably. The present developments have therefore gone towards partially or fully submerged structures, serving as oil production and storage units at an off-shore production site. These structures are preferably of the type which is designed to be towed out to a desired location where they are fully submerged or partly submerged to a semi-submerged position.

The structures comprise therefore one or more cells which serve as ballast and/or storage compartments; a pipe arrangement for supplying or removing ballast, for transportation of hydrocarbons from an oil source to the storage compartments, for transportation of hydrocarbons from the storage compartments to shore, or for ventilation of the storage tanks, etc; anchor means; and interconnecting means connecting the floating structure with the anchor means.

Also, because the off-shore oil activities have reached off-shore areas with large shipping volumes, a structure where the possibilities of oil leakages because of a collision between a ship and the floating structure or because of a blow-out are reduced, is required. A marine structure according to the present invention is preferably made of concrete. It should be noted, however, that the structure alternatively may be made of any other suitable material. The floating structure is preferably of the type comprising a fully or partly submerged caisson with a superstructure projecting up from the caisson and preferably up above the sea level, when in operational position, supporting a deck structure. The floating structure may, however, be of any other suitable form or type and be fully or partly submerged.

Further, because of the increasing depths at which the structure is intended to operate and because of off-shore oil explorations in areas with extreme severe wind and wave action causing enormous loads and moments on the structures, the use of gravity type of structures, e.g. structures resting on the sea bed, is limited.

In order to reduce the effect caused by the structure on to the sea bed due to wave and wind action, and in order to limit both vertical and lateral movement of a floating platform structure, it has been proposed to pivot an off-shore drilling platform for hydrocarbons at its base in order to allow the platform to oscillate above the pivot. The platform structure is kept stable by upward hydrostatic pressure and the structure is equipped with storage and ballast compartments. According to a particular proposed solution described in U.S. Pat. No. 3,667,240, an off-shore drilling platform for hydrocarbons has an oscillating column, pivoted at its base and kept stable by upward hydrostatic pressure, with hydrocarbon storage in the column. The differences in the densities of water and hydrocarbons in the column is compensated whereby the forces acting on the base of the column and on the pivot remain substantially constant. The column has two compartments, a lower one filled with water and an upper one forming a float. Compensating means are pumps and valves arranged so that when the hydrocarbon is introduced into the lower compartment it drives out water and corresponding mass of liquid is pumped into the upper compartment. The platform structure according to U.S. Pat. No. 3,667,240, is connected to a base anchored to the sea bed with an articulation or universal joint therebetween.

It has also been proposed to use a floating structure anchored to the sea bed by means of anchors and elongated members interconnecting members being parallel and horizontally spaced apart and tensioned to hold the floating structure at a substantially constant distance above the sea bed. It has further been proposed to provide the anchor means with compartments for ballast.

In accordance with the present invention, a floating structure comprises buoyancy means, anchor means at the bottom of a body of water in which the structure is floating, at least one vertical elongated member interconnecting the buoyancy means and the anchor means, and a plurality of substantially horizontal members interconnecting the buoyancy means and the anchor means, the vertical elongated member being preferably placed centrally in the floating structure. Both the vertical elongated members and the horizontal members are preferably flexible and suitably may be cables of wire, chain, rods, tubes or the like.

According to a second embodiment of the present invention, the anchor means consist of a plurality of cells which serve as both ballast and storage compartments. The anchor means may for example consist of a number of tubular and contiguous cells, the whole structure being monolithically formed. One end of each of the horizontal interconnecting means may be fixed to a column projecting up from the anchor means, these columns being arranged along the outer edge of the anchor means.

The other end of each of the horizontal interconnecting means is fixed to the lower edge of the buoyancy means.

Off-shore platforms according to the present invention offer numerous advantages, and the following in particular:

The produced minerals can be stored in situ, thus saving time. No substantial variation occurs in the magnitude of the reactions and moments on the bottom support for the platform structure. The reaction on the sea bed caused by the platform structure due to wave and wind action is reduced compared with a gravity structure of same size.

There are no universal joints between the buoyancy means and the anchor means, only flexible interconnecting means. The maintenance and corresponding substitution of defect parts become less complicated.

The above and other important objects and advantages of the present invention may best be understood from the following detailed description, constituting a specification of the same, when considered in conjunction with the annexed drawings, wherein:

FIG. 1 shows a sectional elevation of one embodiment of the invention having a floating structure and anchor means for attachment to the bottom of a body of water in which the floating structure is floating;

FIG. 2 shows a horizontal section of the embodiment of FIG. 1, along line 2 — 2 on FIG. 1, showing the relative disposition of the floating structure with the submerged anchoring body and the cables forming the interconnecting means;

FIG. 3 shows a horizontal section taken along line 3 — 3 on FIG. 1;

Figure 4:
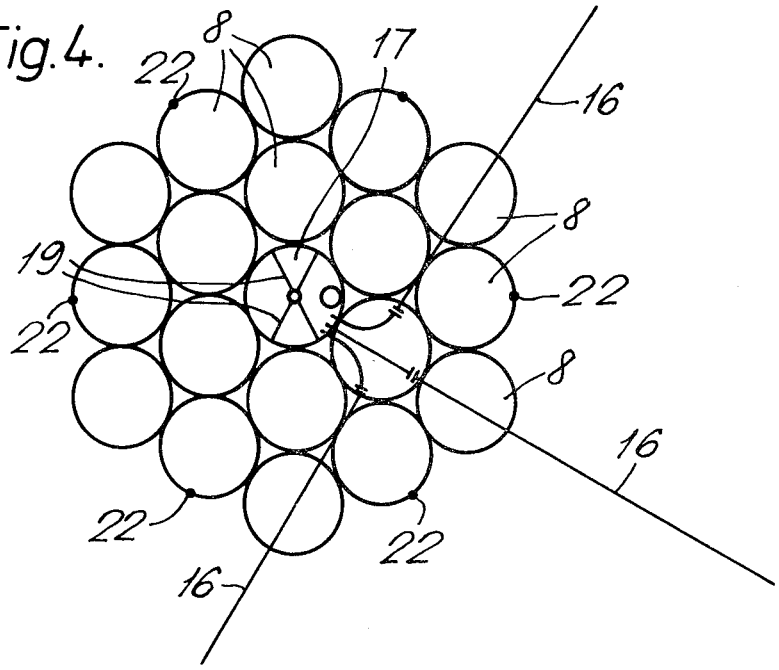
FIG. 4 shows a schematic plan view of the submerged anchoring body.

FIG. 1 illustrates a floating structure 1 and the anchor means 2 according to the present invention. The floating structure 1 consists of a sub-structure 3 and a superstructure 4 projecting up from the sub-structure 3 and above the sea level 5, supporting a deck structure 6. The sub-structure 3 shown on FIGS. 1 and 2 is formed by six elongated cells 8 forming a ring around a central shaft 7, the shaft 7 being open at both ends. The six elongated cells 8 are terminated at both ends by spherical domes 10. The superstructure 4 shown on FIG. 1, is formed by elongating one or more of the cells 8 in the sub-structure, these cells being partly conical. Inside one of the elongated cells forming the superstructure, a utility shaft 9 is arranged.

The anchor means 2 consists of a number of cells 11 forming a monolithic body. The cells 11 may for example serve as storage and/or ballast compartments. At its lower end, the anchor means is equipped with a support structure 12 consisting for example of skirts etc.

The cells 11 in the anchor means may also be terminated at both ends by spherical domes. In addition, the anchor means has a skirt construction 12 projecting downwards from the cells 11 of the anchor means, the skirt construction being intended to be pressed down into the sea bed in order to form a foundation for the anchor means.

The floating structure 1 is connected to the anchor means by at least one vertical anchor cable 13, the cable(s) being kept in tension either by means of a winch or winches indicated at 30 on the deck 6 or by means of a position buoyancy of the floating structure. The vertical anchor cable(s) 13 reduces the heave motion of the floating structure. In addition the floating structure is connected to the anchor means by a plurality of more or less horizontal anchor cables 14, these cables being kept in tension. Even though the floating structure is kept in position by tensioned vertical and horizontal cables the floating platform will act as an oscillating structure, pivoted at the anchor means and kept stable by the upward hydrostatic pressure. The cells 8, 11 may serve as storage and/or ballast compartments. The horizontal cables 14 may preferably be arranged as shown on FIG. 2. The central cell may contain sea water as shown on FIG. 1.

FIG. 3 shows a horizontal section taken along line 3 — 3 on FIG. 1, showing a sectional view of the upper part of the floating structure, comprising the cells 3, the superstructure 4, the central cell 7 and the vertical tensioned anchor cable 13, this cable being made up of a number of single cables.

The central cell 7 contains also a number of pipes 15, these pipes serving for example as conductors, risers, communicating pipes between the different cells for supply or removal of ballast and/or oil, ventilation of the cells etc.

FIG. 4 shows a schematic plan view of the submerged anchoring body 11 denoting the cells in this body, and 16 the pipes from for example an oil well, entering into the central cell 17 through tunnels (not shown).

Figure 5:
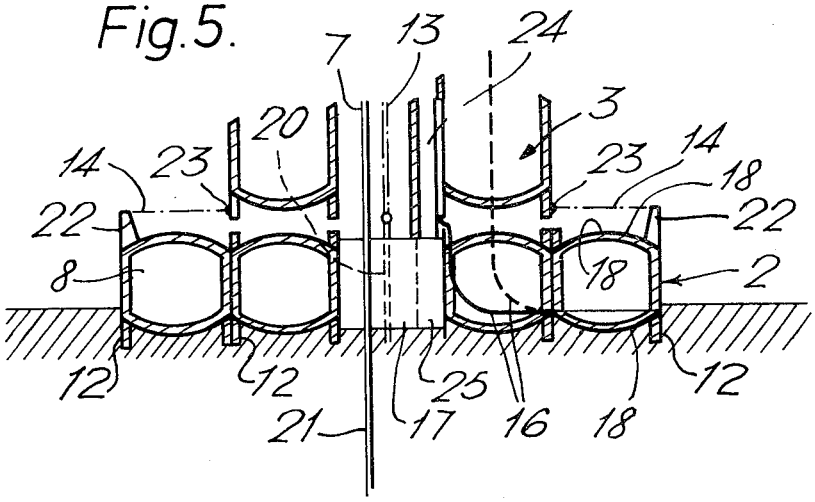
FIG. 5 shows in detail a vertical section through the submerged anchoring body on FIG. 4 and a vertical section through the lower part of the floating structure.

FIG. 5 shows in detail a vertical section through the submerged anchoring body on FIG. 4 and a vertical section through the lower part of the floating structure. The anchoring body 2 consists of a plurality of contiguous cells 11 with spherical upper and lower domes and a central cell. The anchor means 2 is in addition equipped with a downward extending skirt structure 12 intended to be pressed down into the supporting sea bed soil so as to serve as a foundation. The central cell 17 is open in both ends and supports by means of two or more radial walls 19 an anchoring point 20 on the anchor body 2 intended to be connected with the vertical cable. The anchoring point 20 may for example be formed by a column or the like, which column at its upper end is equipped with means for clamping (not shown) the lower end of the vertical tensioned cable 13. This clamping means are of the type which can release the cable 13 if necessary. The number 21 denotes the drilling string. Each of the horizontal tensioned cables 14 is at one end clamped to an upward extending column 22 rigidly supported by the anchor means, while the other end is clamped at 23 to the lower section of the floating body, the clamping means (not shown) being of the type which may release the cable if necessary. On the embodiment shown on FIG. 5, the anchor means is equipped with six upwards projecting columns 22 for clamping the outer ends of the horizontally tensioned cables 14, while the floating body is equipped with twelve clamping means 23, whereby a starshaped system of horizontally tensioned cables 14 as shown on FIG. 2 is obtained. The central cell 17 may also be equipped with a water and pressure tight chamber 25 and a corresponding tunnel or shaft 24 in the central cell 7 of the floating body, the connection between the shaft 24 and the chamber being a conventional flexible connection (not shown), or the tunnel may be released and pulled a few meters up from the chamber 25 in bad weather. The risers may either extend up to the deck through the central cell or through one or more of the cells 3 as shown with dotted line on FIG. 5.

Figure 6:
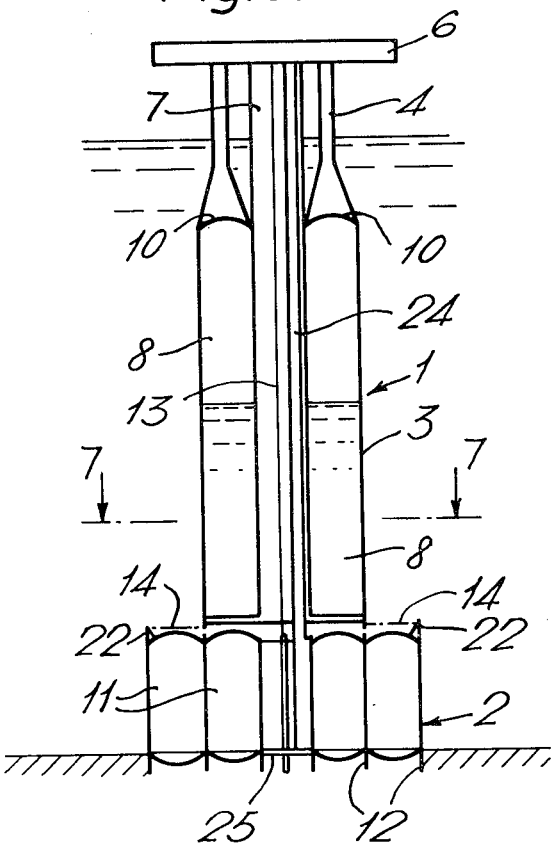
FIG. 6 shows a sectional elevation of a second embodiment of the invention.
Figure 7:
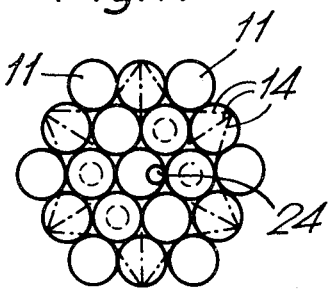
FIG. 7 shows a schematic plan view of the embodiment shown on FIG. 6.

FIG. 6 shows a sectional elevation of a second embodiment of the present invention. Also this embodiment comprises a floating structure 1 consisting of a sub-structure 3 and a superstructure 4 projecting up from the sub-structure 3 and above the sea level 5, supporting a deck structure 6. The sub-structure 3 shown on FIGS. 6 and 7 is formed by six elongated cells 8 forming an outer ring around a central shaft 7, the shaft 7 being open at both ends. The six elongated cells are terminated at both ends by spherical domes 18. Also the superstructure 4 shown on FIG. 6 is formed by elongating one or more of the cells 8 in the sub-structure, these cells being partly conical. The embodiment also comprises an anchor means consisting of a number of cells 11 forming a monolithic body. These cells are designed to serve as storage compartments in addition to ballast compartments. At its lower end, the anchor means is equipped with a support structure 12 consisting for example of skirts or the like. The cells 11 in the anchor means are terminated at both ends by spherical domes. The floating body is connected to the anchor means by at least one vertical cable 13 and a plurality of horizontal cables, the cables being kept in tension. The floating body and the anchoring means are equipped with a shaft or tunnel 24 and a pressure and water tight chamber 25 similar to the one shown on FIGS. 4 and 5.

The anchor means and preferably the lower section of the floating body is built in a dry dock preferably by means of slipforming, the lower part of the floating body being built on top of the anchor means, resting freely on the anchor means. The dock is then filled with water and the anchor means and the lower section of the floating body are towed out to a wet site where the remaining part of the floating body is built using the slipforming technique. When the construction work is finished, the floating body and the anchor means are towed out in an upright position to the operation site, preferably with the floating body resting on the anchor means, whereby the anchor means serve as a buoyancy body.

The anchor means and the floating body are then lowered down on to the sea bed and founded, whereafter the floating body is raised (for example 4 – 5 m) to a higher elevation. During the founding operation the vertical shaft and the pressure and water tight shaft may be used for execution of the founding works. Alternatively, the anchor means is released from the floating body and lowered down on to the sea bed and founded. The floating body is then lowered down to its operational draft either by means of additional water ballast or by a pull cable or by a combination of both. The vertical and the horizontal cables are then tensioned by winches and/or by means of "positive" buoyancy.

The floating platform will now act as an oscillating structure, pivoted at the anchor means and kept stable by upward hydrostatic pressure and the cables. The distance between the anchor means and the floating body when the platform is in operational position may for example be in the order 3 – 7 m.

The vertical cable 13 will together with the positive buoyancy keep the structure in vertical equilibrium while the cables 14 will prevent horizontal and torsional movements of the buoyancy means. In order to prevent torsional movements at least some of the horizontal cables must have a substantial tangential direction to the floating structure. When the buoyancy means oscillates in the waves, some of the horizontal cables 14 will of course to a certain extent get a small elongation. This elongation can be either eithr by flexibility in the cables, by a certain slack in the cables or by "constant tension" winches.

Figure 8:
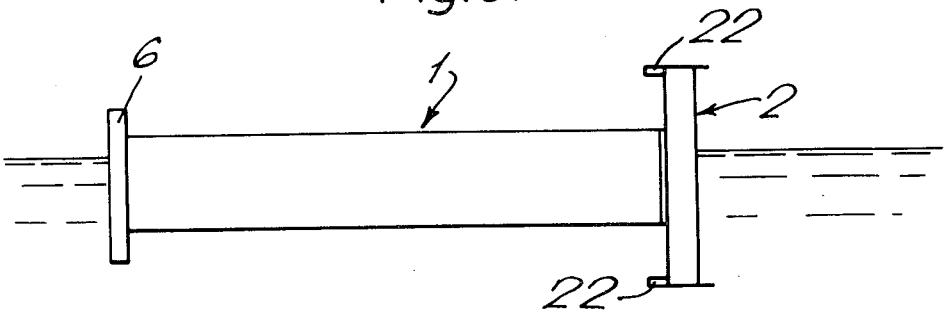
FIG. 8 shows the platform in a horizontal tow-out position.

According to a second preferred method of building the floating body and/or the anchor means is constructed in a horizontal position using conventional shuttering, thereby enabling the platform to be built in more shallow waters than if the platform was to be built in an upright position. The platform is then towed in horizontal position as shown on FIG. 8 out to the operational site. It should also be noted that even though the platform is constructed in an upright position, it may be towed out in a horizontal position. In order to bring the platform from an upright position to a horizontal position and/or from a horizontal position to the upright position for submergence down on to the sea bed, the platform is equipped with a controlled flooding system. By transporting the platform in a horizontal position, the draft is reduced and the platform may be towed in shallow waters.

It is also possible to tow the platform out to the location in a heeling position, for example 45°.

In the above, a floating body with a superstructure consisting of cells with a reduced cross-section area is described. It should be noted, however, that the floating body may have a superstructure having the same cross-section area as the sub-structure, the superstructure being formed by elongating the seven cells in the sub-structure upwards and above the sea level. Such a structure will result in a better support for the deck structure, making better room for the utility shaft and the pipe arrangement in the cells. It should also be noted that such a structure would be much easier to construct.

Figure 9:
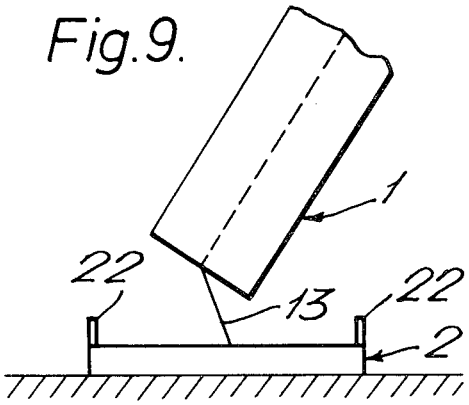
FIG. 9 shows one of the stages in the submergence of the platform.

When installing the platform on the operational site, the anchor means may firstly be submerged down on to the sea bed whereafter the floating body is submerged and connected to anchor means by the vertical and horizontal tensioned cables as shown on FIG. 9, the floating body being pulled down by means of cables and winches (not shown). However, the anchor means and the floating means may be towed out and submerged together, these two means being temporarily connected so as to form one unit with the floating body resting on the anchor means.

In such a case, an improved stability during towing and submergence is obtained together with larger available penetration forces.

Figure 10:
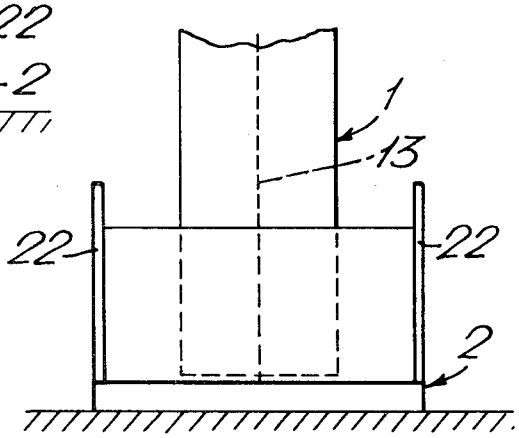
FIG. 10 shows a third embodiment of the present invention.

According to the embodiment shown on FIG. 10, the columns 22 are prolonged upwards and they are equipped with clamping means at different heights, whereby the distance between the lower end of the floating body and the upper end of the anchor means may be varied. According to the embodiment shown on FIG. 10 the floating body may rest on the anchor means during submergence and tow out as shown with the dotted lines. When the anchor means is installed and founded the floating body is raised to a higher elevation as shown on FIG. 10. This embodiment provides better stability during tow out, greater flexibility with respect to the depth at which the platform can work etc. The construction of such a platform may be initiated before the depth at the operational site is decided.

Figure 11:
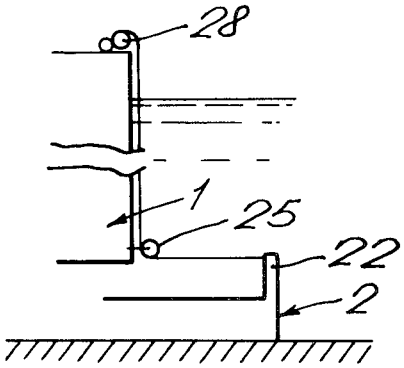
FIG. 11 shows a fourth embodiment of the invention.

One of the best assets of the present invention is the possibility of maintenance and substitution of defect vertical and horizontal cables without having to break off the functions of the platform. This work may either be effected by divers or from the deck. FIG. 11 shows a schematic view of one embodiment of the anchoring system. According to this embodiment each cable is clamped at one end on the column 22 extending upwards from the anchor means. The cables run over pulleys 25 fixed at the lower end of the floating body and up towards the deck where the other end is connected to a winch 28 or the like (not shown). The winch 28 is used to control the pull in the wire or cable, preferably keeping a constant tension.

Figure 12:
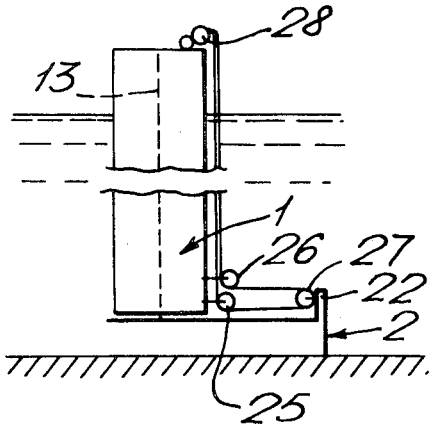
FIG. 12 shows a fifth embodiment of the invention.

FIG. 12 shows a second embodiment of the cable arrangement. According to this embodiment each cable extends vertically downwards from the deck to a pulley 27 on the anchor means over a pulley 25 on the lower end of the floating body, returning to a winch 28 on deck via a third pulley 26 attached to the lower end of the floating body.

According to this embodiment constant tension in the cables may be obtained and controlled from the deck. In addition maintenance and substitution of defect cables may easily be executed from the deck without the costly use of divers etc. In order to change defect cables, it is possible to join the new cable on to the defect one and pull the cable around until the new cable returns to the deck.

Alternatively the cable may be pulled a short distance at a time whereby the wear on the cable will be more or less uniform and defect sections continuously replaced. Also, the cable needs only withstand half the tension of a single-cable solution. It should be noted that the platform according to the present invention to a certain extent will oscillate resulting in a limited angular movement, and that the deflection of the pipes and the tunnel in the central cell will be taken up by the elasticity of the pipes and the tunnel.

I claim:

1. A floating off-shore platform which, in operation, is anchored to the sea bed by an anchoring means, said platform comprising an elongated floating structure which, in operation, floats in an upright position; an anchor means which, in operation, is founded on the sea bed beneath the floating structure; at least one vertically elongated member interconnecting the floating structure and the anchor means; means, located on said platform, for tensioning the at least one vertically elongated member so as to restrain vertical displacement of the floating structure; a plurality of horizontal members interconnecting the lower end of the floating structure and the anchor means; and means, located on said platform, for tensioning said horizontal member so as to restrain lateral displacement of the lower end of the floating structure.

2. A marine structure according to claim 1, wherein the vertical elongated member is placed centrally on the marine structure.

3. A marine structure according to claim 1, wherein both the vertical and the horizontal members are flexible.

4. A marine structure according to claim 1, wherein one end of each of the horizontal members is fixed to a column projecting up from the anchor means.

5. A marine structure according to claim 4, wherein the columns are equipped with clamping means fixed at different heights, whereby the distance between the lower end of the buoyancy means and the upper end of the anchor means may be varied.

6. A marine structure according to claim 1, wherein each of the horizontal members runs from a column on the anchor means over a pulley on the lower end of the floating structure and up to a winch on a deck on the marine structure.

7. A marine structure according to claim 1, wherein each of the horizontal members extends vertically down from a winch on the deck to a pulley on the anchor means via a pulley on the lower end of the buoyancy means and back to the winch on the deck via a third pulley fixed on the lower end of the buoyancy means.

8. A marine structure according to claim 1, wherein the tension in both the vertical and the horizontal members is kept substantially constant.

9. A marine structure according to claim 1, wherein the horizontal cables diverge out from the columns on the anchor means in order to reduce angular displacement of the floating structure.

* * * * *